US007302994B2

(12) United States Patent
Mautino et al.

(10) Patent No.: US 7,302,994 B2
(45) Date of Patent: Dec. 4, 2007

(54) METHOD AND SYSTEM FOR MANUFACTURING A COUPLER KNUCKLE

(75) Inventors: P. Scott Mautino, Pittsburgh, PA (US); Joseph L. Gagliardino, Oakdale, PA (US); Michael D. Maxeiner, Coraopolis, PA (US)

(73) Assignee: McConway & Torley, LLC, Pittsburgh, PA (US)

( * ) Notice: Subject to any disclaimer, the term of this patent is extended or adjusted under 35 U.S.C. 154(b) by 42 days.

(21) Appl. No.: 11/296,051

(22) Filed: Dec. 6, 2005

(65) Prior Publication Data

US 2007/0125510 A1 Jun. 7, 2007

(51) Int. Cl.
*B22D 33/04* (2006.01)

(52) U.S. Cl. ..... 164/137; 164/368; 213/75 R

(58) Field of Classification Search ..... 164/137, 164/368; 213/75 R
See application file for complete search history.

(56) References Cited

U.S. PATENT DOCUMENTS 2,688,412 A * 9/1954 Kulieke ..... 213/155
4,024,958 A 5/1977 Kaufhold ..... 213/152
4,206,849 A 6/1980 Kaim ..... 213/151
4,605,133 A 8/1986 Altherr ..... 213/155
4,811,854 A 3/1989 Elliott ..... 213/155
5,582,307 A * 12/1996 Hawthorne et al. ..... 213/109
6,622,776 B2 9/2003 Bauer et al. ..... 164/137

FOREIGN PATENT DOCUMENTS

GB 743098 A 11/1956

* cited by examiner

*Primary Examiner*—Jonathan Johnson
*Assistant Examiner*—I.-H. Lin
(74) *Attorney, Agent, or Firm*—Baker Botts L.L.P.

(57) ABSTRACT

A method for manufacturing a railcar coupler knuckle includes providing a cope mold portion and a drag mold portion. The cope and drag mold portions have internal walls defining at least in part perimeter boundaries of a coupler knuckle mold cavity. The method includes positioning one or two internal cores within either the cope mold portion or the drag mold portion. The one or two internal cores are configured to define a kidney cavity, a finger cavity and a pivot pin cavity of a coupler knuckle. The method includes closing the cope and drag mold portions with the one or two internal cores therebetween and at least partially filling the mold cavity with a molten alloy, the molten alloy solidifying after filling to form the coupler knuckle.

2 Claims, 5 Drawing Sheets

METHOD AND SYSTEM FOR MANUFACTURING A COUPLER KNUCKLE

TECHNICAL FIELD OF THE INVENTION

This invention relates in general to railcars and, more particularly, to a method and system for manufacturing a coupler knuckle.

BACKGROUND OF THE INVENTION

Railcar couplers are disposed at each end of a railway car to enable joining one end of such railway car to an adjacently disposed end of another railway car. The engageable portions of each of these couplers is known in the railway art as a knuckle. For example, railway freight car coupler knuckles are taught in U.S. Pat. Nos. 4,024,958; 4,206,849; 4,605,133; and 5,582,307.

Knuckle failure accounts for about 100,000 train separations a year, or about 275 separations per day. Most of these separations occur when the train is out of a maintenance area. In such cases, a replacement knuckle, which can weigh about 80 pounds, must be carried from the locomotive at least some of the length of the train, which may be up to 25, 50 or even 100 railroad cars in length. The repair of a failed coupler knuckle can be labor intensive, can sometimes take place in very inclement weather and can cause train delays.

Coupler knuckles are generally manufactured from a cast steel using a mold and three cores. During the casting process itself the interrelationship of the mold and three cores disposed within the mold are critical to producing a satisfactory railway freight car coupler knuckle. Many knuckles fail from internal and/or external inconsistencies in the metal through the knuckle. If one or more cores move during the casting process, then some knuckle walls may end up thinner than others resulting in offset loading and increased failure risk during use of the knuckle.

SUMMARY OF THE INVENTION

The present invention provides a method and system for manufacturing a coupler knuckle that substantially eliminates or reduces at least some of the disadvantages and problems associated with previous methods and systems.

In accordance with a particular embodiment, a method for manufacturing a railcar coupler knuckle includes providing a cope mold portion and a drag mold portion. The cope and drag mold portions have internal walls defining at least in part perimeter boundaries of a coupler knuckle mold cavity. The method includes positioning one or two internal cores within either the cope mold portion or the drag mold portion. The one or two internal cores are configured to define a kidney cavity, a finger cavity and a pivot pin cavity of a coupler knuckle. The method includes closing the cope and drag mold portions with the one or two internal cores therebetween and at least partially filling the mold cavity with a molten alloy, the molten alloy solidifying after filling to form the coupler knuckle.

Positioning one or two internal cores may comprise positioning one internal core comprising a kidney portion configured to define the kidney cavity of the coupler knuckle, a finger portion configured to define the finger cavity of the coupler knuckle and a pivot pin portion configured to define the pivot pin cavity of the coupler knuckle. Positioning one or two internal cores may comprise positioning two internal cores. The two internal cores may comprise a first internal core comprising a kidney portion configured to define the kidney cavity of the coupler knuckle and a second internal core comprising a finger portion configured to define the finger cavity of the coupler knuckle and a pivot pin portion configured to define the pivot pin cavity of the coupler knuckle. The one or two internal cores may comprise a sand resin.

In accordance with another embodiment, a system for manufacturing a railcar coupler knuckle includes a cope mold portion and a drag mold portion having internal walls defining at least in part perimeter boundaries of a coupler knuckle mold cavity. The system includes one or two internal cores configured to be positioned within either the cope mold portion or the drag mold portion. The one or two internal cores are configured to define a kidney cavity, a finger cavity and a pivot pin cavity within a coupler knuckle formed upon the closing of the cope and drag mold portions with the one or two internal cores therebetween, the at least partial filling of the mold cavity with a molten alloy and the solidifying of the molten alloy after filling to form the coupler knuckle.

In accordance with another embodiment, a railcar coupler knuckle includes a tail section, a hub section and a nose section. The tail, hub and nose sections define internal cavities comprising a kidney cavity, a finger cavity and a pivot pin cavity. The internal cavities are formed using one or two internal cores during manufacturing of the coupler knuckle.

Technical advantages of particular embodiments include a system and method for manufacturing a coupler knuckle using fewer than three cores for forming internal cavities within the knuckle. For example, a single core may be used to form kidney, finger and pivot pin cavities within the knuckle. Accordingly, a stronger and more efficient knuckle is manufactured because there are fewer cores to move during casting. In addition, less materials are required to manufacture the coupler knuckle since nails and/or chaplets will not be needed to hold in place three separate cores in the cope and drag mold sections. Moreover, the manufacturing process for the knuckle may take less time and labor since fewer cores need to be positioned within a mold cavity for casting.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

For a more complete understanding of the present invention and its advantages, reference is now made to the following description, taken in conjunction with the accompanying drawings, in which.

DETAILED DESCRIPTION OF THE INVENTION

Figure 1:
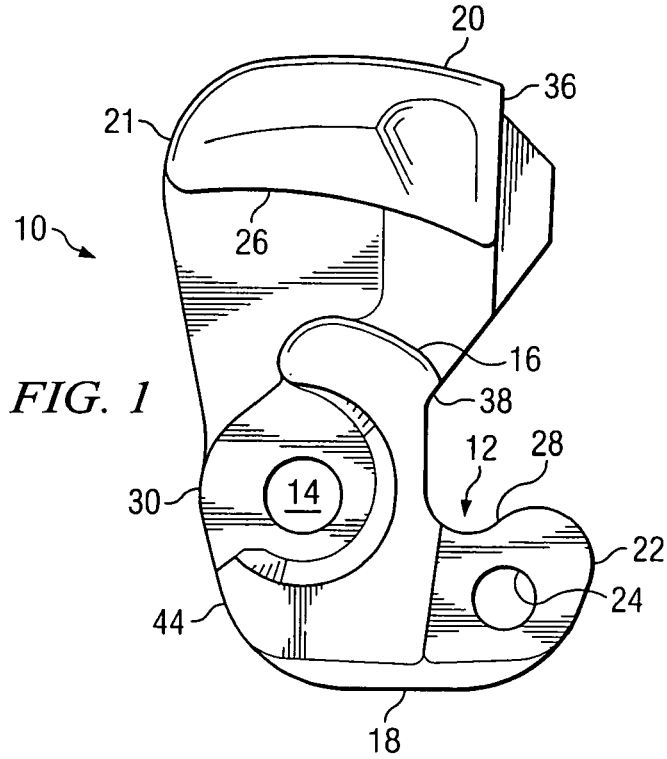
FIG. 1 illustrates a top view of an example coupler knuckle 10 in accordance with a particular embodiment of the present invention.

FIG. 1 is a top view of an example coupler knuckle 10 in accordance with a particular embodiment. Coupler knuckle 10 includes a tail section 20, a hub section 30 and a front face section 18. Hub section 30 includes a pivot pin hole 14 formed therein for receiving a pivot pin to pivotally couple the knuckle 10 to a coupler for coupling to a railcar. Pivot pin hole 14 may have generally cylindrical sidewalls and may have a middle region lacking sidewalls. Coupler knuckle 10 also includes a buffing shoulder 16, a tail stop 21, a pulling lug 26, a lock wall 36, a throat 38 and a heel 44.

Front face section 18 includes a nose section 22, which includes a generally cylindrical flag opening 24 formed in an end region of the nose section 22. A pulling face portion 28 is disposed inwardly from nose section 22. At least a portion of the pulling face portion 28 includes a bearing surface area 12 which bears against a similar surface of a coupler knuckle of an adjacent railcar to couple the railcars together.

Figure 2:
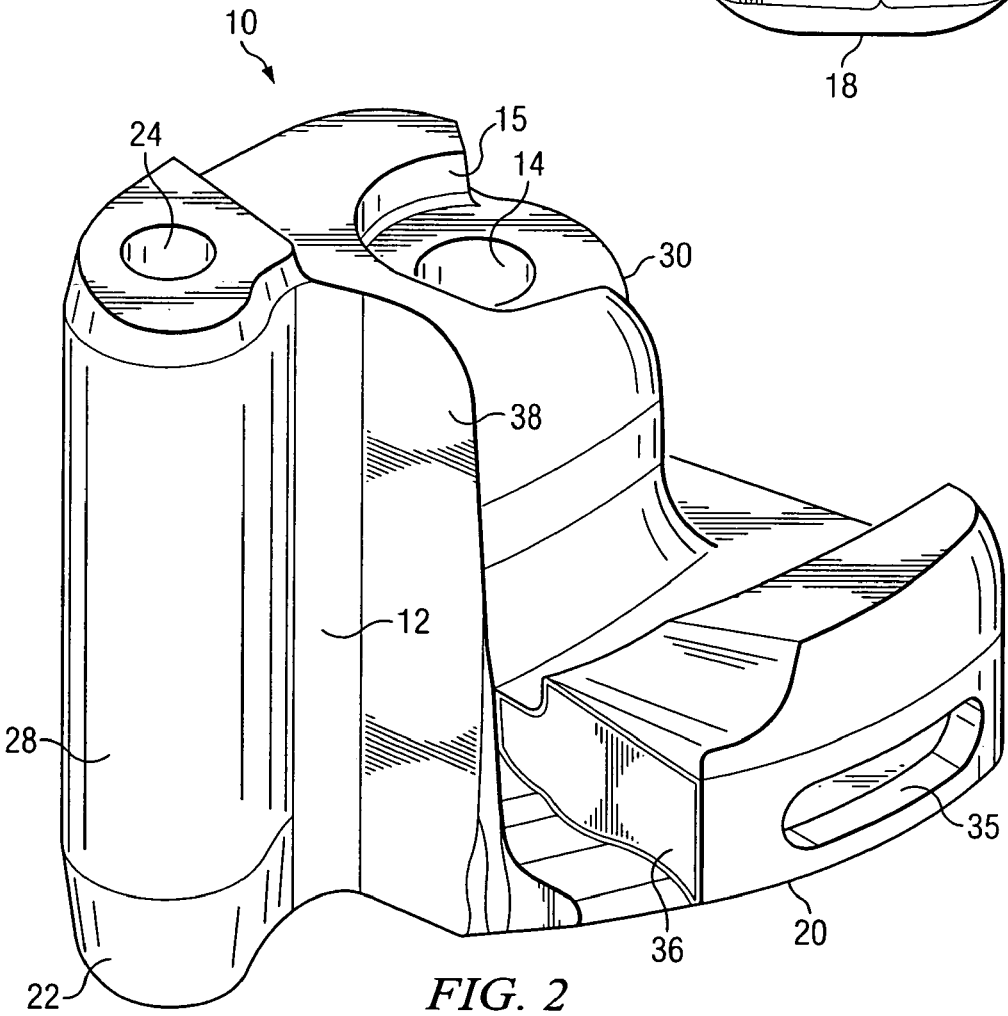
FIG. 2 is an isometric view of the coupler knuckle of FIG. 1.
Figure 3:
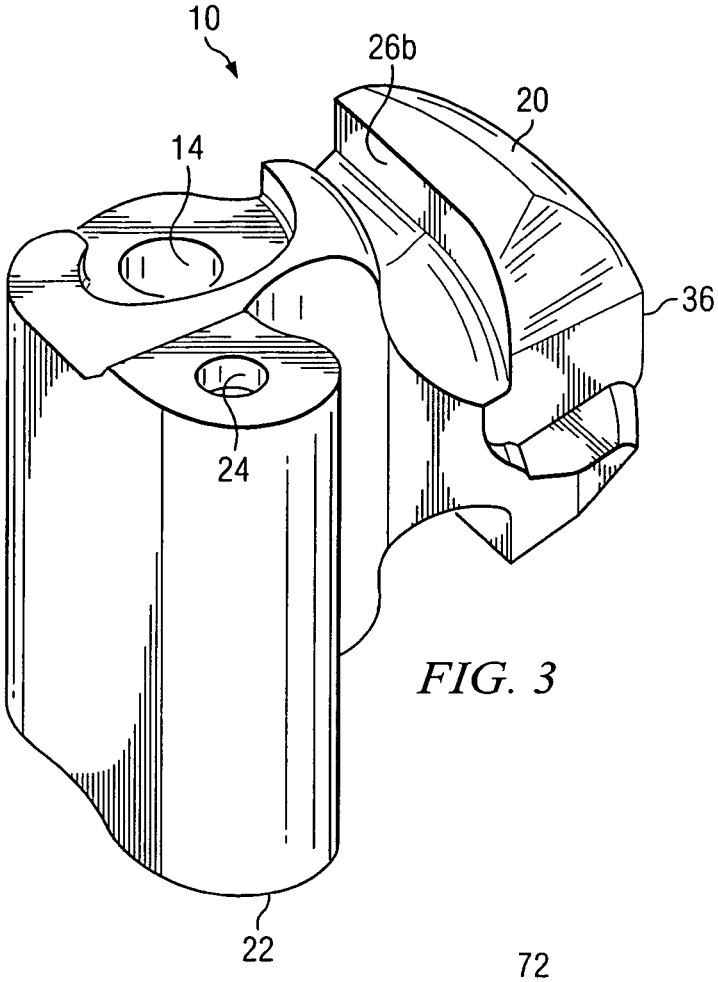
FIG. 3 is another isometric view of the coupler knuckle of FIG. 1.

FIGS. 2 and 3 are isometric views of the example coupler knuckle 10 of FIG. 1. Evident in FIGS. 2 and/or 3 are tail section 20, nose section 22, pulling lug 26, hub section 30, bearing surface 12, pivot pin hole 14, flag opening 24, pulling face portion 28, lock wall 36 and throat 38. Tail section 20 includes an opening 35. The illustrated embodiment also includes a pin protection portion 15 to provide protection for the pivot pin during use of the knuckle.

Coupler knuckles include various cavities that conform to standard specifications as set forth by the Standard Coupler Manufacturers Committee. Casting gages are designed to be applied to the coupler knuckle in a prescribed manner to verify that certain dimensions of the knuckle fall within an allowable variation or tolerance range. Gages have a primary role in guaranteeing the uniformity of all manufacturers' knuckles. Railroad cars that operate in interchange traffic, switching from one train to another, are required to be equipped with couplers and other draft system components which will reliably mate with other assembly components.

One manner in which a coupler knuckle may be manufactured to conform to standard specifications is through a casting process with steel or other alloy. The casting process typically includes the use of at least three cores that aid in forming the appropriate cavities within the coupler. The cores are typically made of resin or otherwise hardened sand. These three cores are sometimes referred to as a kidney core, a finger core and a pivot pin core.

Specifically, the coupler knuckle is produced in a mold cavity within a casting box between cope and drag sections. Sand, such as green sand, is used to define the interior boundary walls of the mold cavity. The mold cavity may be formed using a pattern and may include a gating system for allowing molten alloy to enter the mold cavity.

Figure 4:
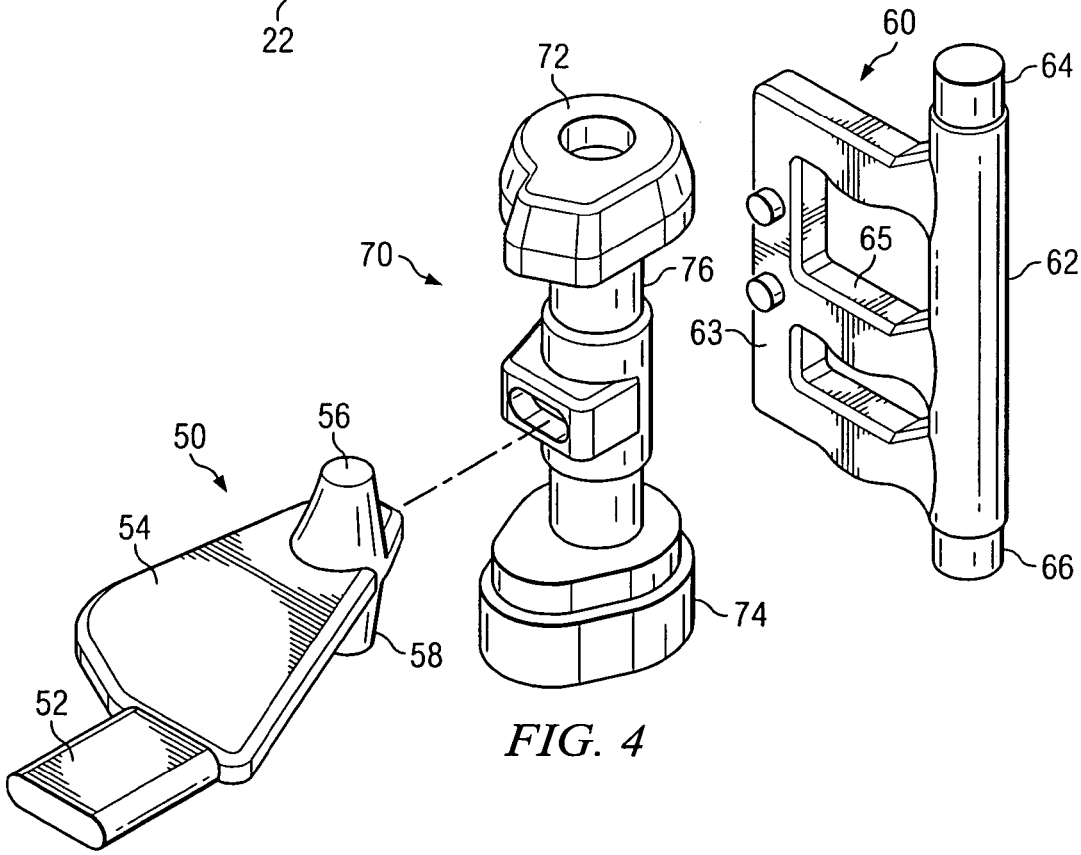
FIG. 4 illustrates a kidney core, a finger core and a pivot pin core used in a coupler knuckle casting process.

FIG. 4 illustrates a kidney core 50, a finger core 60 and a pivot pin core 70 used in a coupler knuckle casting process to form appropriate cavities within the knuckle. It should be understood some in the art may reference kidney, finger and pivot pin cores by other names. For example, some may refer to the kidney core as described herein as a pulling lug core and may refer to the finger core described herein as a face core. It should be understood that particular embodiments apply to all knuckles having internal cavities formed that are similar to those internal cavities formed by the kidney, finger and pivot pin cores or core portions described below.

Kidney core 50 forms a cavity in the throat portion of the coupler knuckle. Kidney core 50 includes a rear lug or projection 52 which forms opening 35 in the knuckle. Kidney core 50 includes a central body portion 54 as well as upper and lower projections 56 and 58 that extend upwardly and downwardly from central body portion 54.

Finger core 60 forms a cavity extending through the coupler knuckle beginning at flag opening 24. Finger core 60 includes a shaft 62 between upper projection 64 and lower projection 66. Upper projection 64 forms flag opening 24 in the knuckle. Finger core 60 also includes an extended portion 63 which extends towards pivot pin core 70 when placed into the knuckle mold for casting the knuckle. Finger core 60 also includes a rib portion 65 forming an opening within the knuckle to allow the knuckle to be formed with less metal, resulting in lighter weight, while still retaining internal strength.

Pivot pin core 70 has a generally cylindrical shape and forms a cavity in the coupler knuckle for the insertion of a pivot pin to couple the knuckle to a coupler. Pivot pin core 70 includes a top portion 72 and a bottom portion 74 connected by an pivot core shaft 76. In the illustrated embodiment, pivot pin core 70 includes an enlarged portion 78 which results in an enlarged void within the pivot pin cavity of the coupler knuckle.

Portions of the illustrated cores may comprise core prints that are not enclosed by a cast coupler knuckle. For example, at least part of enlarged top portion 72 and enlarged bottom portion 74 of pivot pin core 70 may end up external to the cast knuckle and may thus not form an internal cavity of the knuckle.

In the typical manufacturing process of a coupler knuckle, these cores are placed into the mold cavity. They may be placed in the drag portion prior to closing of the mold assembly by placing the cope portion on top of the drag portion. In some cases, they are coupled to each other and/or the cope and/or drag sections using various tools, such as nails and chamfers. Once the cores are in place, the cope and drag mold portions may be brought together and closed along their parting line. The cavity may be filled with molten alloy, which takes up all the space open between the cope and drag portions and the cores. After solidifying, the cope and drag mold portions are separated, and the casting is shaken out resulting in the breaking up of the cores and their exit from designed openings in the casting.

When manufacturing a coupler knuckle using three separate cores to form the knuckle's internal cavities, the three separate cores may move relative to one another resulting in internal knuckle walls of improper or undesired thickness. This can lead to offset loading and increased failure risk during use of the knuckle.

Figure 5:
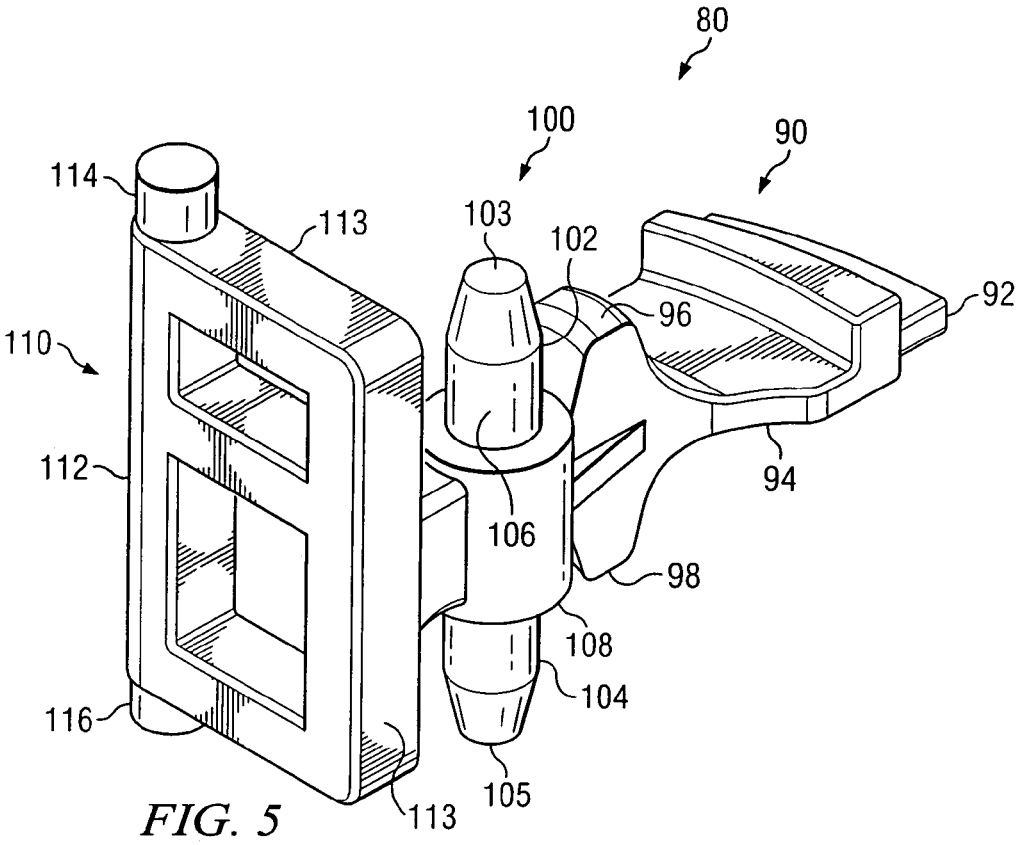
FIG. 5 illustrates a single core that may be used in a manufacturing process to form internal cavities of a coupler knuckle, in accordance with a particular embodiment.

Therefore, particular embodiments provide for the manufacturing of a coupler knuckle using fewer than three cores to form internal cavities of the knuckle. FIG. 5 illustrates a single core 80 that may be used in such manufacturing process in accordance with a particular embodiment. Core 80 includes a kidney portion 90, a pivot pin portion 100 and a finger portion 110 which form similar internal couple knuckle cavities to those formed by separate kidney cores, pivot pin cores and finger cores typically used in the coupler knuckle manufacturing process. As illustrated, kidney portion 90, pivot pin portion 100 and finger portion 110 are joined together to form a single core. Single cores described herein may be formed using any suitable method, such as by gluing together various pieces to form the core. In some cases, such pieces glued together may comprise separate kidney, pivot pin and/or finger portion cores.

Using a single core increases the efficiency and strength of the coupler knuckle. There is a greater likelihood that the internal cavities and walls of the knuckle will be of proper thickness since there are fewer internal cores to move around in the casting process. In addition, less materials are required to manufacture the coupler knuckle since nails and/or chaplets will not be needed to hold in place three separate cores in the cope and drag mold sections.

Kidney portion 90 of core 80 includes projection 92 which to form opening 35 in the knuckle. Kidney portion 90 also includes central body portion 94 as well as upper and lower projections 96 and 98 that extend upwardly and downwardly from central body portion 94. Particular embodiments may not include upper and lower projections on a kidney or any other portion.

Pivot pin portion 100 of core 80 includes top portion 102 and bottom portion 104 connected by a pivot core shaft 106. Pivot pin portion 100 also includes enlarged portion 108. In the illustrated embodiment, pivot pin portion 100 also includes core prints 103 and 105 which may comprise extensions not enclosed by a final cast knuckle made with core 80. Finger portion 110 of core 80 includes a shaft 112 between upper core print 114 and lower core print 116 and extended portion 113 extending approximately towards pivot pin portion 100.

It should be understood that particular embodiments may include cores with any number of core prints extending from any particular location. Such core prints may include portions that are not internal to the knuckle when the knuckle is ultimately cast around the core.

Figure 6:
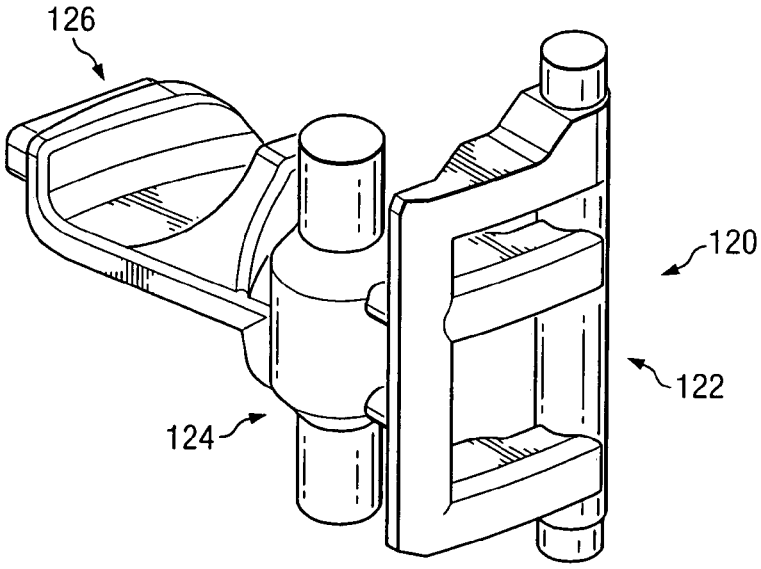
FIG. 6 illustrates another single core that may be used in a manufacturing process to form internal cavities of a coupler knuckle, in accordance with another embodiment.

FIG. 6 illustrates a single core 120 used in the manufacturing process of a coupler knuckle, in accordance with another embodiment. Core 120 includes finger portion 122, pivot pin portion 124 and kidney portion 126 that form internal cavities similar to those typically formed by separate finger, pivot pin and kidney cores in the knuckle manufacturing process. Finger portion 122 includes upper and lower core prints in the illustrated embodiment.

Finger, pivot pin and kidney portions of a core are described herein as each forming a respective cavity, but it should be understood that these respective cavities may in actuality be a single cavity since a single core may be used in the manufacturing process (i.e., the cavities may join together). For example, a single core used in the casting process of a coupler knuckle may form one large cavity within the knuckle, and the one large cavity may include a kidney cavity portion, a pivot pin cavity portion and a finger cavity portion—each of these cavity portions may be referred to as a respective cavity herein.

In particular embodiments, two internal cores may be used to manufacture a coupler knuckle—a first core that corresponds to either a kidney, pivot pin or finger core and another core that corresponds to a combination of the used in the first core. For example, a coupler knuckle may be manufactured with a typical kidney core and another core that combines a pivot pin and finger core into one core with pivot pin and finger portions, similar to the manner in which the kidney, pivot pin and finger cores are combined to form single cores 80 and 120 discussed above. As another example, a coupler knuckle may be manufactured with a typical finger core and another core that combines a pivot pin and kidney core into one core with pivot pin and kidney portions.

Figure 7:
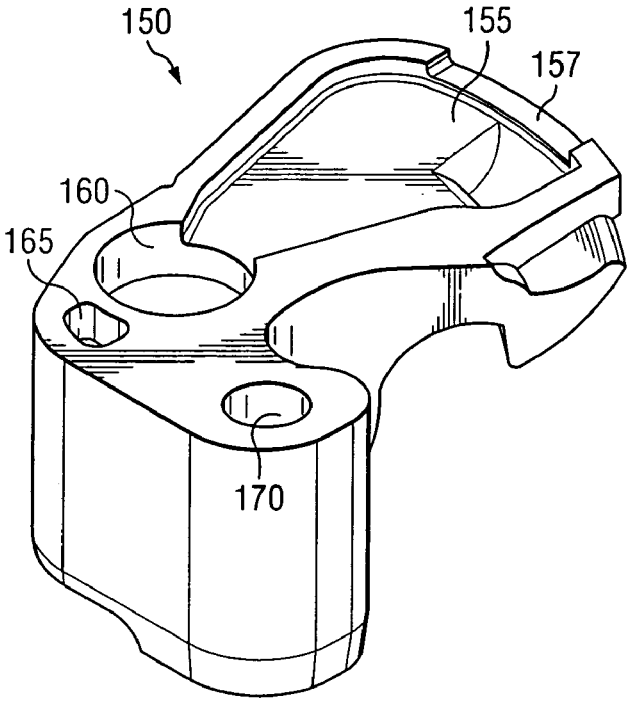
FIG. 7 illustrates a bottom portion of a coupler knuckle manufactured in accordance with a particular embodiment.

FIG. 7 illustrates a bottom portion of a coupler knuckle 150 manufactured using a single core, in accordance with a particular embodiment. Coupler knuckle 150 is manufactured using a single core that includes a kidney portion, a pivot pin portion and a finger portion, similar to core 120 discussed above. Couple knuckle 150 includes a kidney cavity 155 formed by a kidney portion of a core used in the manufacturing process, a pivot pin cavity formed by a pivot pin portion of the core used in manufacturing and finger cavities 165 and 170 formed by a finger portion of the core used in manufacturing. Kidney cavity 155 includes opening 157 in the knuckle which may correspond to opening 35 of knuckle 10 in FIG. 2. Opening 157 may be formed by a projection of the kidney portion of the manufacturing core, similar to projection 92 of kidney portion 90 of core 80. Finger cavity 170 may correspond to a cavity formed by a shaft of the finger portion of the manufacturing core, similar to shaft 112 of finger portion 110 of core 80. Finger cavity 165 may correspond to a cavity formed by an extended portion of the finger portion of the manufacturing core, similar to extended portion 113 of finger portion 110 of core 80.

Figure 8:
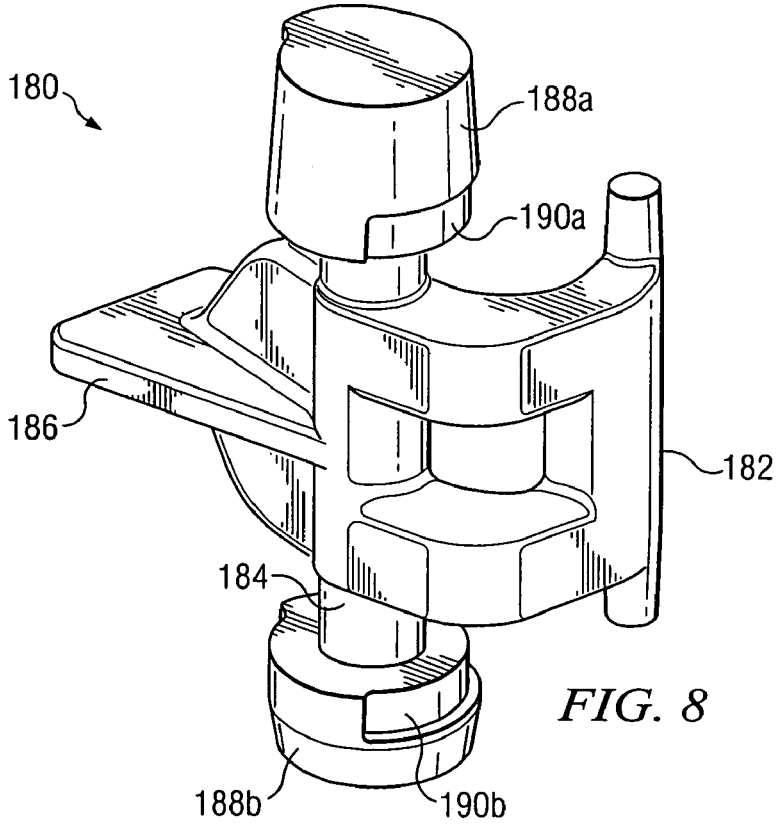
FIG. 8 illustrates another single core that may be used in a manufacturing process to form internal cavities of a coupler knuckle, in accordance with another embodiment.

FIG. 8 illustrates a single core 180 used in the manufacturing process of a coupler knuckle, in accordance with another embodiment. Core 180 includes finger portion 182, pivot pin portion 184 and kidney portion 186 that form internal cavities similar to those typically formed by separate finger, pivot pin and kidney cores in the knuckle manufacturing process. In the illustrated embodiment, kidney portion 186 does not include a projection similar to projection 92 of kidney portion 90 of core 80. Thus, a knuckle formed by core 180 may not include an opening in its tail section exterior similar to opening 35 of knuckle 10 or opening 157 of knuckle 150.

In addition, pivot pin portion 184 includes hub sections 188*a* and 188*b*. Hub sections are enlarged sections used in the creation of a portion of the knuckle. Hub sections 188 each include a respective groove 190 to create a pin protector portion on a knuckle to aid in the protection of the pivot pin during knuckle use. Such a pin protector portion may be similar to pin protection portion 15 of knuckle 10.

While the illustrated embodiment includes a core having a kidney portion without a projection to form an opening in a tail section of a knuckle and a pivot pin portion with hub sections, it should be understood that other embodiments may not include these elements, such as hub sections or may include a kidney portion projection as discussed above with respect to particular embodiments.

Figure 9:
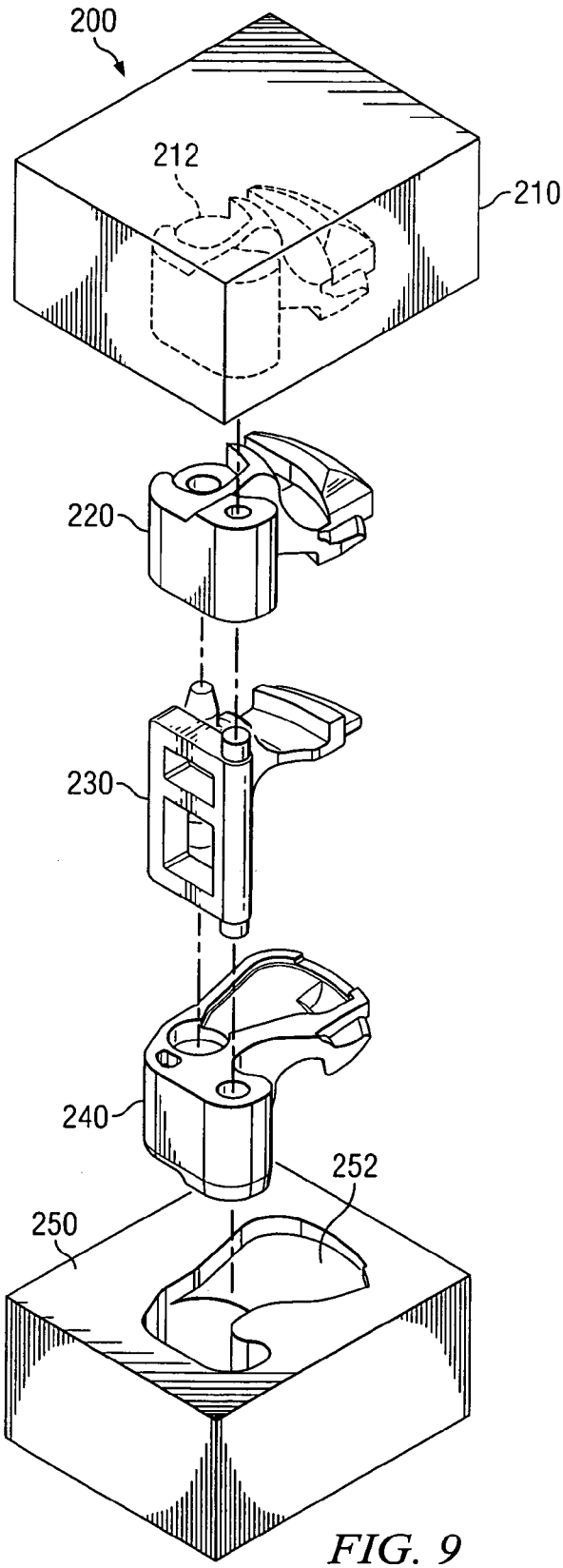
FIG. 9 is a schematic illustration of a coupler knuckle manufacturing assembly, in accordance with a particular embodiment.

FIG. 9 is a schematic illustration of a coupler knuckle manufacturing assembly 200, in accordance with a particular embodiment. Knuckle manufacturing assembly 200 includes a cope mold section 210, an upper section 220 of a coupler knuckle, a single core 230 used in the manufacturing process, a lower section 240 of the coupler knuckle and a drag mold section 250.

Cope mold section 210 and drag mold section 250 include mold cavities 212 and 252, respectively, into which a molten alloy is poured to cast the coupler knuckle. Mold cavities 212 and 252 are configured to correspond to the desired external surfaces of the coupler knuckle to be manufactured using cope and drag mold sections 210 and 250. Core 130 includes finger, pivot pin and kidney portions to form corresponding cavities within the coupler knuckle as described above.

Figure 10:
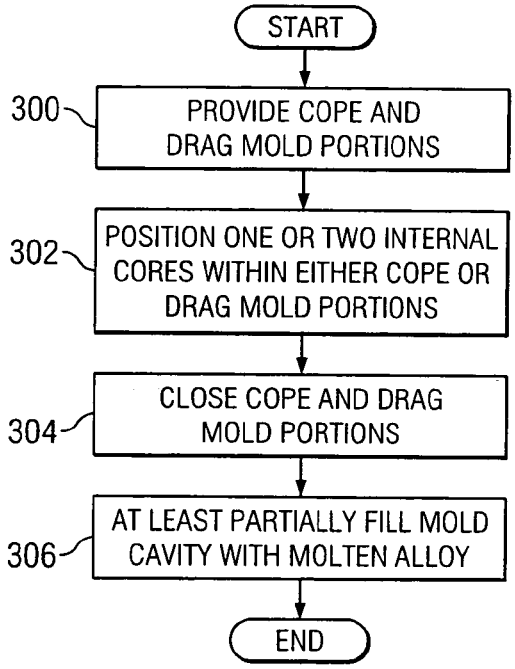
FIG. 10 is a flowchart illustrating a method for manufacturing a railcar coupler knuckle, in accordance with a particular embodiment.

FIG. 10 is a flowchart illustrating a method for manufacturing a railcar coupler knuckle, in accordance with a particular embodiment. The method begins at step 300 where cope and drag mold portions are provided. The cope and drag mold portions may each include internal walls, formed of sand using a pattern or otherwise, that define at least in part perimeter boundaries of a coupler knuckle mold cavity. The mold cavity corresponds to the desired shape and configuration of a coupler knuckle to be cast using the cope and drag mold portions.

At step 302, one or two internal cores are positioned within either the cope mold portion or the drag mold portion. The one or two internal cores are configured to define a kidney cavity, a finger cavity and a pivot pin cavity within a coupler knuckle. For example, a single core may be used that includes a kidney portion, a finger portion and a pivot pin portion that form the kidney, finger and pivot pin cavities, respectively. Since a single core may be used, the kidney, finger and pivot pin cavities may actually be one continuous space. In some embodiments, two cores may be used that in combination include kidney, finger and pivot pin portions to form the internal coupler knuckle cavities.

At step 304, the cope and drag mold portions are closed with the one or two internal cores therebetween using any suitable machinery. At step 306, the mold cavity including the one or two internal cores is at least partially filled, using any suitable machinery, with a molten alloy which solidifies to form the coupler knuckle.

Some of the steps illustrated in FIG. 10 may be combined, modified or deleted where appropriate, and additional steps may also be added to the flowchart. Additionally, steps may be performed in any suitable order without departing from the scope of the invention.

It should be understood that while particular cores comprising kidney, pivot pin and finger portions corresponding to kidney cores, pivot pin cores and finger cores are illustrated and described herein, other embodiments may include coupler knuckles manufactured with cores having kidney, pivot pin and finger portions that have different shapes or configurations than those illustrated and described but that still conform to the necessary coupler knuckle specifications. For example, in some embodiments a finger portion may have a different number of rib portions than the finger portions illustrated herein. Other cores used in manufacturing in accordance with particular embodiments may include additional differences.

While particular internal cores used in the manufacturing process of coupler knuckles are discussed herein, it should be understood that coupler knuckles may be manufactured with other, external cores, such as cores that aid in forming particular external surfaces on the coupler knuckle such as a bearing surface of an appropriate or desired configuration.

Coupler knuckles manufactured in accordance with particular embodiments may be provided in the combination of a railway freight car coupler (not shown) having incorporated therein the coupler knuckle casting formed using one or two internal cores. The knuckles may also be configured to be suitable for retrofitting an existing railway freight car couplers (not shown).

Although the present invention has been described in detail with reference to particular embodiments, it should be understood that various other changes, substitutions, and alterations may be made hereto without departing from the spirit and scope of the present invention. The present invention contemplates great flexibility in the manufacturing process of coupler knuckles and the shape, configuration and arrangement of one or more internal cores used in the manufacturing process.

Numerous other changes, substitutions, variations, alterations and modifications may be ascertained by those skilled in the art and it is intended that the present invention encompass all such changes, substitutions, variations, alterations and modifications as falling within the spirit and scope of the appended claims.

What is claimed is:

1. A method for manufacturing a railcar coupler knuckle, comprising:

providing a cope mold portion and a drag mold portion, the cope and drag mold portions having internal walls defining at least in part perimeter boundaries of a coupler knuckle mold cavity;

positioning one internal core within either the cope mold portion or the drag mold portion, the one internal core configured to define a kidney cavity, a finger cavity and a pivot pin cavity within a coupler knuckle;

closing the cope and drag mold portions with the one internal core therebetween; and at least partially filling the mold cavity with a molten alloy, the molten alloy solidifying after filling to form the coupler knuckle wherein the internal core comprising:

a kidney portion configured to define the kidney cavity of the coupler knuckle;

a finger portion configured to define the finger cavity of the coupler knuckle; and a pivot pin portion configured to define the pivot pin cavity of the coupler knuckle.

2. The method of claim 1, wherein the one internal core comprises a sand resin.

* * * * *